United States Patent [19]

Sinykin

[11] Patent Number: 4,897,941

[45] Date of Patent: Feb. 6, 1990

[54] SNOW GROOMING COMB

[75] Inventor: William B. Sinykin, Logan, Utah

[73] Assignee: Logan Manufacturing Company, Logan, Utah

[21] Appl. No.: 396,925

[22] Filed: Aug. 21, 1988

[51] Int. Cl.[4] ..... E01H 4/00

[52] U.S. Cl. ..... 37/222; 37/221; 172/684.5

[58] Field of Search ..... 37/220, 221, 222, 223, 37/219; 172/197, 198, 764, 765, 766, 684.5

[56] References Cited

U.S. PATENT DOCUMENTS

| | | | |
|---|---|---|---|
| 1,592,731 | 7/1926 | Francis | 172/766 X |
| 1,651,247 | 11/1927 | Bodenstein et al. | 37/219 |
| 3,478,827 | 11/1969 | Madson | 172/766 X |
| 3,835,932 | 9/1974 | Mitchell | 172/197 |
| 4,359,831 | 11/1982 | Beeley | 37/258 |
| 4,412,589 | 11/1983 | Francis | 172/197 X |
| 4,616,581 | 10/1986 | Brothers | 172/197 X |
| 4,651,450 | 3/1987 | York et al. | 37/219 X |
| 4,651,451 | 3/1987 | Beeley et al. | 37/219 |
| 4,718,183 | 1/1988 | Haug | 37/221 |
| 4,726,129 | 2/1988 | Haug | 37/222 |
| 4,738,037 | 4/1988 | Haug | 37/222 |

FOREIGN PATENT DOCUMENTS

| | | | |
|---|---|---|---|
| 3333941 | 4/1985 | Fed. Rep. of Germany | 37/220 |
| 1168647 | 7/1983 | U.S.S.R. | 37/220 |

*Primary Examiner*—Randolph A. Reese
*Assistant Examiner*—J. Russell McBee
*Attorney, Agent, or Firm*—A. Ray Osburn

[57] ABSTRACT

An improved snow comb for use attached to the trailing edge of tiller skirts and the like. The comb has lateral rows of axially elongate teeth projecting downward from a plate attached to the skirt. The teeth are tapered forwardly, and are alternately longer and shorter so as to work the tilled snow horizontally as well as vertically for more complete powdering.

5 Claims, 5 Drawing Sheets

SNOW GROOMING COMB

BACKGROUND OF THE INVENTION

1. Field

The field of the invention is apparatus for preparing and grooming snow slopes for skiing, and more particularly devices for finally smoothing the snow after tilling or other initial preparation.

2. State of the Art

Various snow grooming devices have been used to smooth and recondition the snow of ski slopes. These are generally drawn over the snow behind a tracked vehicle, which often carries a forward blade for preliminary leveling of the snow. Harrows, discs, rollers, snow compacting bars and tillers are examples of these devices. Perhaps the most widely used are the snow tillers, which are powered to aggressively break up and cut snow which is excessively packed from extended use or weather conditions. While it is not "powder", tilled snow is in the form of relatively small aggregated pieces, and when lightly but firmly packed provides easy, enjoyable skiing. Tillers commonly in use have blades on rotating cutter bars covered by a hood with its trailing portion or edge positioned near the snow surface to smooth and compact the cut and chopped snow. Initially, the metallic edge of the skirt was relied upon, and no further conditioning of the snow was provided. Later, a flexible, a saw-toothed-edged member was attached to the skirt trailing edge, such as member 33 disclosed in U.S. Pat. No. 4,359,831. Positioned to bear forceably upon the snow, the trailing edge comb structure 33 further crushed and reduced snow lumps and the like, considerably improving the final surface for skiing. Subsequently, more elaborate devices were employed in the skirt trailing edge area. Instead of the short, saw-tooth member, devices of much greater length proved advantageous. These members bore forcibly downward upon the snow over an increased area of contact, and more effectively powdered the snow. The sawtooth edge comb teeth evolved into parallel ridges, elongate in the direction of travel, bearing generally horizontally upon the snow. Powdering was improved by the ridges. Later, a second and then a third row were used, the individual ridges axially aligned from row to row. The ridges of each row were of equal length and were positioned side by side. A substantial space was provided between succeeding rows, allowing increased flexibility for more extended snow contact. However, even the best of these prior art final grooming combs produced snow surfaces more grooved, more ridged, and harder than was desirable. With some snow conditions, these ridges were so pronounced and rigid as to seize the edges of skis, causing falls and the like. Clearly, although the prior art final grooming devices had been improved considerably, further improvement was needed for safer, more enjoyable skiing.

BRIEF SUMMARY OF THE INVENTION

With the foregoing in mind, the present invention eliminates or substantially alleviates the disadvantages in prior art snow grooming combs by providing an elongate, generally flexible, snow contacting plate member adapted to be attached along the trailing edge of the skirt of a forwardly moving rotary snow tiller or other snow grooming device, the plate having a multiplicity of snow contacting teeth standing downward from its lower surface, each tooth being elongate in the direction of travel. The teeth are arranged equally spaced in at least one row laterally to the direction of travel.

Each tooth is generally triangular in cross section. In the leading row, an elongaate rearmost portion of each tooth joins a foremost portion, which tapers upwardly and inwardly to a front tip at the under-surface of the plate.

The teeth of the leading row are alternately longer and shorter, and positioned with rearmost ends laterally aligned. The snow is thus first broken by the foremost tips of the longer teeth, and subsequently mulched horizontally in the rearwardly narrowing spaces therebetween. It is then further crushed and mulched when encountered by the shorter teeth.

Preferably, at least one additional lateral row of alternately longer and shorter teeth is provided, rearwardly spaced from the leading row, with the longer and shorter teeth respectively aligned with the shorter and longer of the teeth of the leading row. Horizontal compression of the snow is repeated, again followed by further mulching by the shorter teeth in this row.

The repeated horizontal crushing action of the rearwardly narrowing spaces between teeth, accompanied always by substantial downward pressure from the forcibly curved resilient plate member, produces more thoroughly powdered snow, mulched to a softness minimizing any ski edge seizure.

An additional rearmost row of equal length teeth is preferably employed to smooth the thoroughly crushed snow into the final skiing surface.

For users who prefer a powdered, rather than a corduroy appearing final surface, a trailing attachment may be provided, with downstanding harrowing spikes. It is therefore the principal object of the invention to provide an improved comb device for use in the final step of conditioning snow of slopes for enjoyable, safer skiing.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
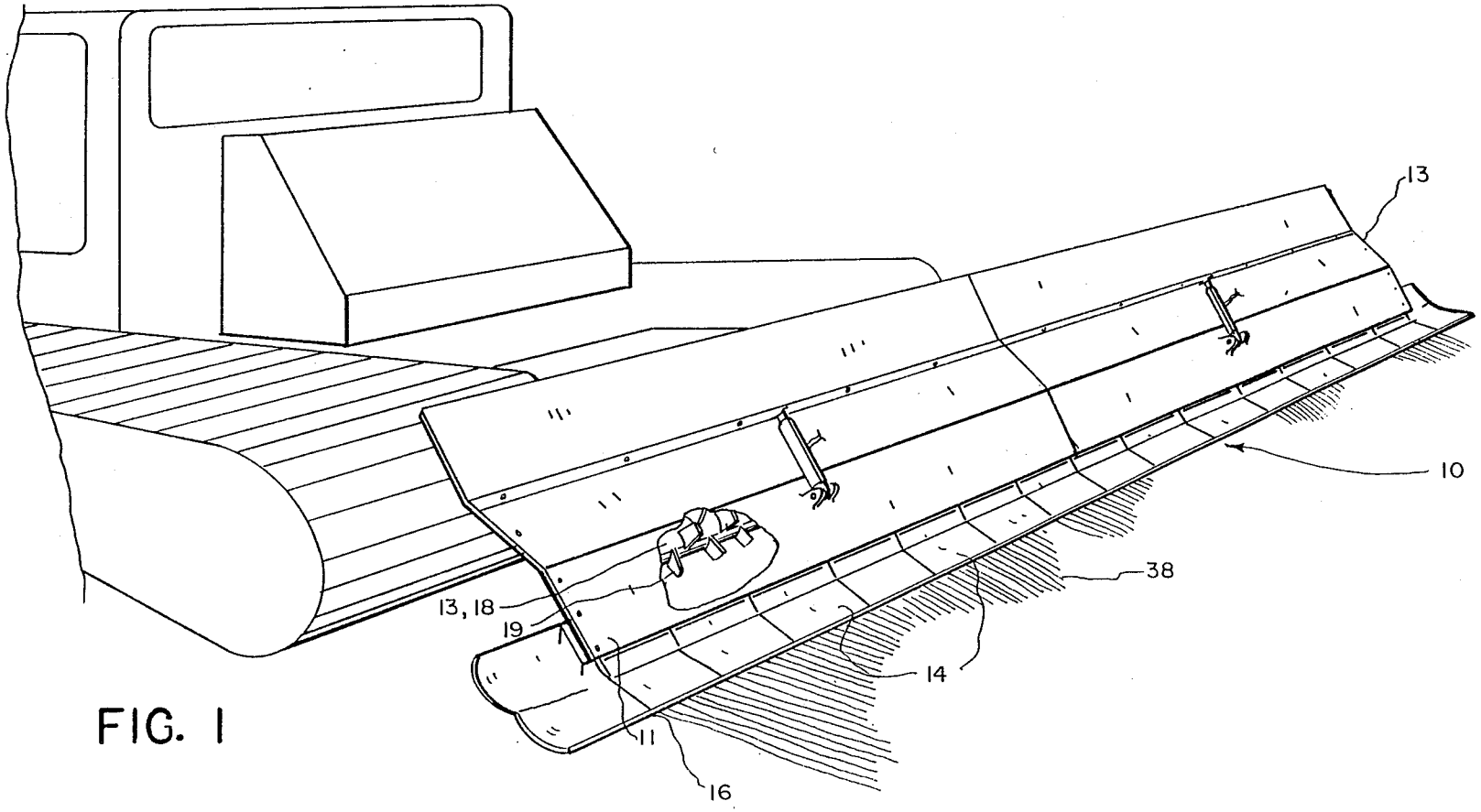
FIG. 1 is a perspective view of a ski slope grooming comb in accordance with the invention adhered to the trailing edge of a snow grooming tiller towed by a tracked vehicle, fragmentally indicated, drawn to a reduced scale.

In FIG. 1, a snow comb assembly 10 is illustrated secured along the trailing edge 11 of a skirt or hood 12 of a snow tiller 13. Comb assembly 10 comprises comb segments 14, each constructed of flexible elastic material, preferably plastic. An elastic cord 15 maybe employed installed laterally through the segment trailing edge portion 16 by way of bores 17, to enable the segments 14 to act together in response to local variations in the elevation of the surface of the snow.

Figure 2:
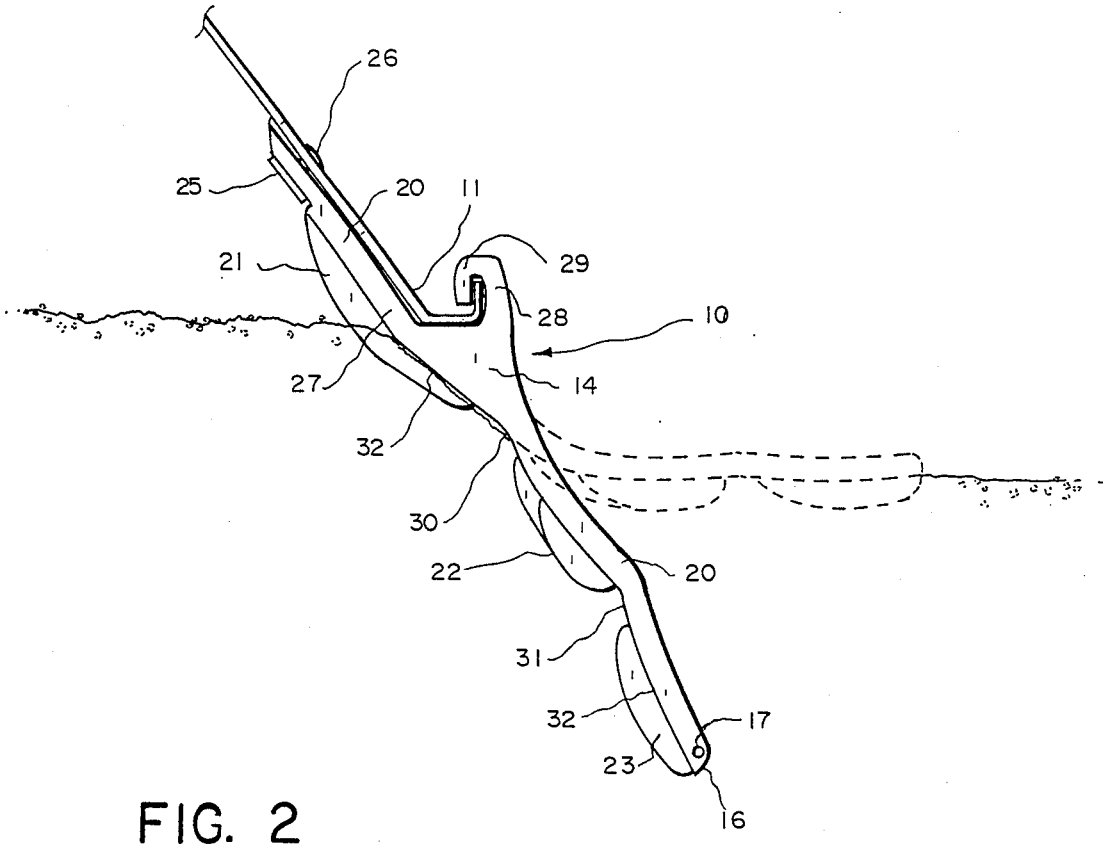
FIG. 2 is a side view of one of the comb segments of FIG. 1, with its operating position indicated in dashed lines, drawn to a larger scale, FIG. 3 a bottom view of the segment of FIG. 2, drawn to a somewhat larger scale, FIG. 4 a bottom view of an embodiment of one of the comb segments of FIG. 1, having a skewed rearmost row of teeth, the teeth thereof being only partially shown, drawn to the scale of FIG. 3, and FIG. 5 a perspective view of a fragment of a trailing edge attachment for a comb in accordance with the invention, to smooth any ridges in the snow left by the comb trailing edge, drawn to a slighly larger scale than FIG. 3.

In FIG. 2, a comb segment 14 is represented in operation attached to the trailing edge 11 of tiller skirt 12. Snow tiller 13 typically has a powered rotating cutter bar 18. The teeth 19 chop, grind and stir the snow beneath hood 12 into a loose tumbled, chunky condition not the most desirable for pleasurable skiing. However, the tumbled snow is collected by skirt 12 and crushed and compacted at trailing edge 11, aided by comb assembly 10, as now described.

Each comb segment 14 comprises a backbone plate 20 from which extend downwardly foremost, intermediate and rearmost rows 21, 22 and 23, respectively, of snow grooming teeth 24, said rows being spaced apart in the direction of tiller travel. A steel mounting strip 25 cooperates with comb mounting bolts 26 to secure the front portion 27 of backbone 20 to the underside of skirt 12. Molded hook and slot 28 engages the edge stiffener curl 29 of skirt trailing edge 11. Foremost row of teeth 21 is generally centered beneath skirt curl 29. Being securely attached to skirt 12 and curl 29, this forward portion of comb 14 is substantially restrained from flexing. Backbone plate 20, along with the teeth of foremost row 21, is angled upward at curl 29 into a more horizontal direction, but is then angled oppositely, so that its intermediate portion with tooth row 22 is essentially parallel to its foremost portion. The trailing portion carrying row 23 of teeth, is angled slightly downward to compensate for any uplift from the surface of the snow that might occur from bending of backbone 20 at a more forward location. Backbone 20 is relatively free to bend at tooth-free areas 30 and 31 between tooth rows, flexing with the pressure of the snow surface upon tooth rows 22 and 23, while exerting positive downward pressure.

The foremost row 21 of teeth 24 is rendered substantially rigid and unyielding, supported by the trailing edge 11 of skirt 12, itself made rigid by curl 29. All of the elongate downstanding teeth 24 of the rows 21, 22 and 23 are preferably shaped to both cut and crush snow lumps and the like. Each has a near triangular, apex downward, cross section, and each in the forward direction tapers upwardly and inwardly to meet at its tip 33 at the lower surface 32 of backbone plate 20. The triangular shape of the teeth of front row 21 may be truncated to form a narrow flat lowermost surface 34, to more effectively crush the initially chunky snow.

The mere fact of the snow being successively worked by three rows of teeth has in prior art combs gone far toward reducing the snow to acceptable condition. However, the selected geometry of the teeth of comb 10, and their particular placement upon backbone 20 produces an improved, more powderlike snow condition.

Figure 3:
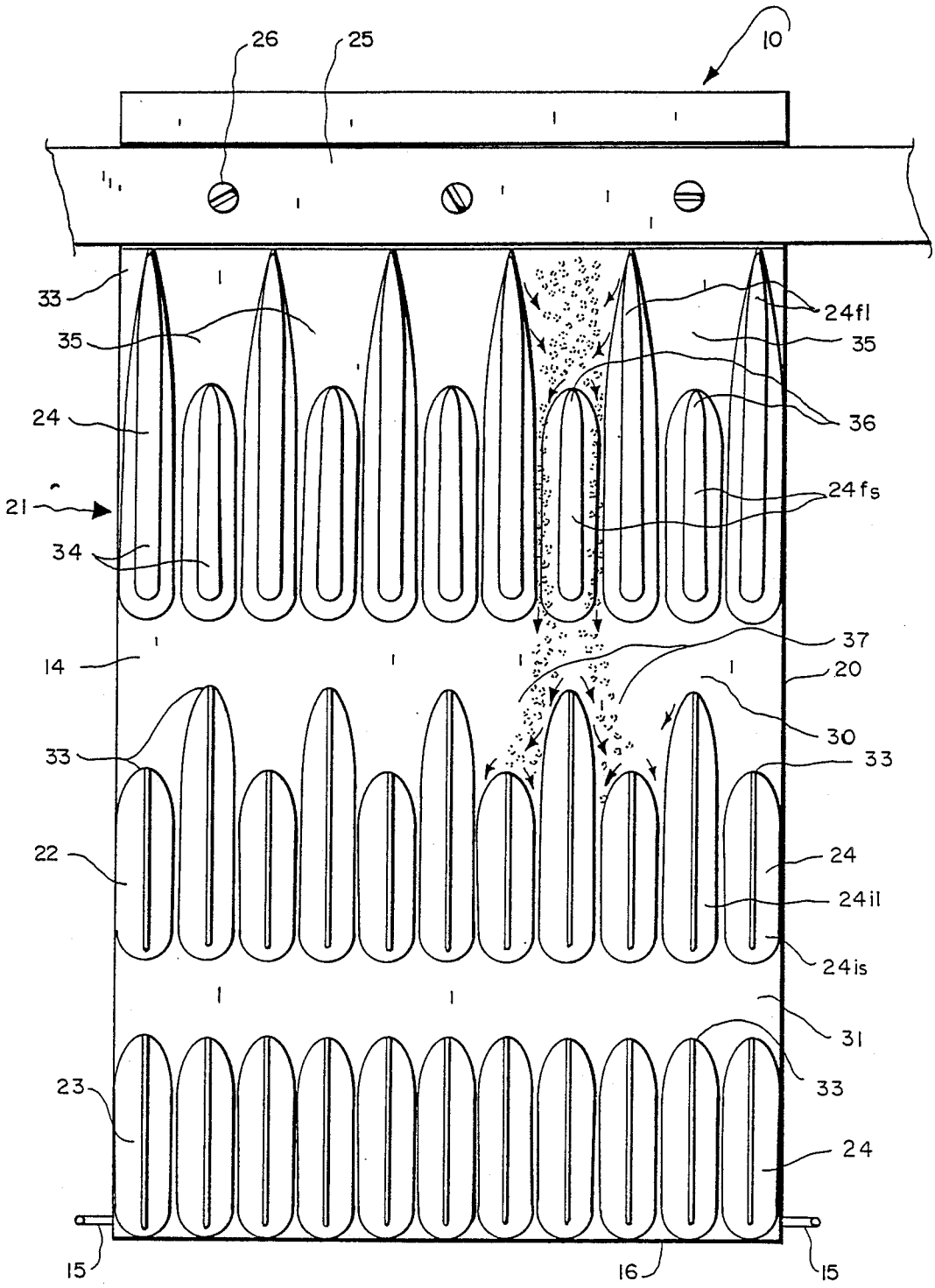

FIG. 3 provides an upwardly seen view of the bottom side of comb segment 14. Foremost row 21 comprises longer forwardly extending teeth 24fl alternating with shorter teeth 24fs. The forward tapering ends of teeth 24fl create rearwardly narrowing spaces 35 therebetween. It is speculated that the inwardly and downwardly tapering sides of the more elongate teeth 24fl trap portions of a surface layer of the snow, compressing it horizontally in the rearwardly narrowing space 35, as comb segment 14 is drawn forwardly. Thus, the snow is subjected initially to both horizontal and vertical forces acting on snow lumps and the like. The snow is then further crushed when met by the cutting ends 36 of the shorter teeth 24fs.

Intermediate row 22 also comprises alternating longer and shorter teeth 24il and 24is is respectively. The shorter teeth 24is of this row 22 are aligned with the longer teeth 24fl of forward row 21. The snow previously conditioned as above described by the teeth of row 21 is again gathered and horizontally compressed, this time in the spaces 37 between the longer teeth 24il, to again be further mulched by the shorter teeth 24is. Because of the alignment of the shorter teeth of row 22 with the longer teeth of row 21, and vice versa, each space 37 of row 22 is positioned to gather portions of snow initially gathered at two of the spaces 35 of row 21. This assures more uniform powdering of the snow. When the surface layer of the snow is thus thoroughly worked by both row 21 and row 22 of teeth 24, it is reduced to a desirable powdered condition.

Figure 4:
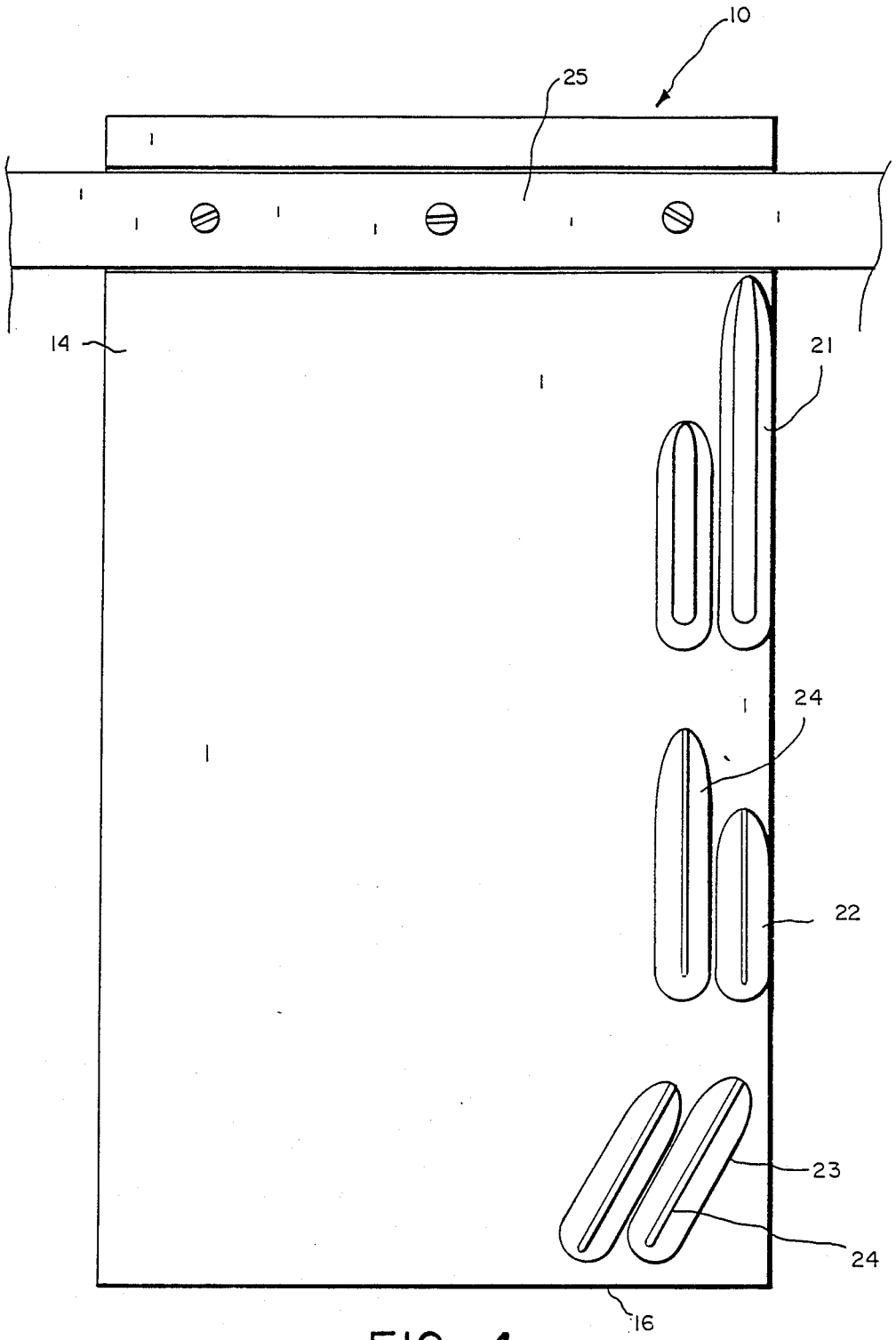

A third row 23 of teeth 24 of uniform length provides the final snow surface in the usually desired corduroy pattern 38. (FIG. 1) Some users object to the appearance of the corduroy pattern 38. Further, if the tilled snow is damp, the ridges may subsequently freeze and then tend to seize ski edges. The same result may occur from partial melting after grooming followed then by subsequent freezing. Teeth 24r of rearmost row 24 may be angled from the direction of travel to prevent formation of the ridges and the usual corduroy pattern. (FIG. 4) The snow surface may be still further powdered by the addedd compaction component of the angled teeth. To prevent unwanted sidewards movements of snow, oppositely directed angling may be desirable where two or more rows are so angled.

Figure 5:
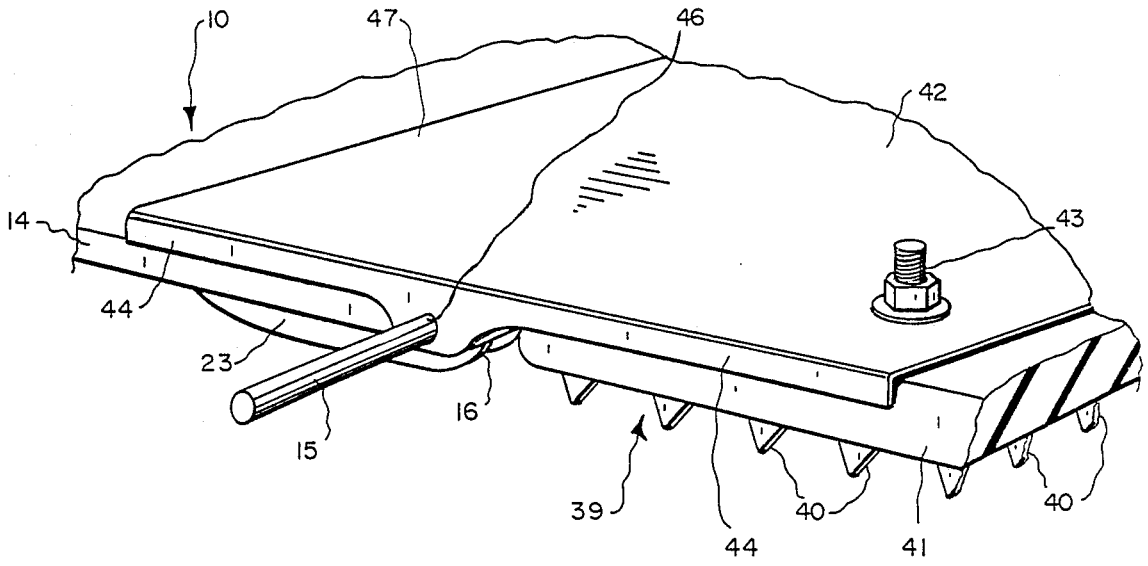

However, many do not find the corduroy pattern 38 objectionable. To satisfy both preferences, comb 10 may incorporate axially directed teeth in rearmost row 23, but further comprise a detachable trailing harrow attachment 39. (FIG. 5) Harrow 39 comprises a field of spike projections 40 downstanding from a separate trailing comb section 41. Comb section 41 is secured to a sheet steel bracket 42 as by bolts 43. Sheet 42 has downwardly bent flanges 44 at each end of each comb section 14. Ears 45, with holes 46, permit attachment utilizing the elastic cord 15. Forward extension 47 of bracket 42 bears upon the upper surface of comb segment 14. This prevents upward rotation and maintains spikes 40 in contact with the snow to effectively powder the corduroy ridges into a smooth final surface.

The invention may be embodied in still other specific forms without departing from the spirit or essential characteristics thereof. The present embodiments are, therefore, to be considered as illustrative and not restrictive, the scope of the invention being indicated by the appended claims rather than by the foregoing description, and all changes that come within the meaning and range of equivalency of the claims are, therefore, intended to be embraced therein.

What is claimed and desired to be secured by United States Letters Patent is:

1. A snow combing device adapted to be secured to the trailing edge of the skirt of a snow tilling device, said snow combing device comprising:

an elongate backing plate of resilient elastic material having provisions for securement to the trailing edge;

a laterally directed foremost row of alternately longer and shorter elongate combing teeth downstanding from the backing plate in the vicinity of said trailing edge, the shorter teeth being positioned between rearward portions of the longer teeth, each of the teeth having a rearmost elongate portion of generally triangular cross section and a foremost portion joining the rearmost portion and tapering therefrom laterally and upwardly to a point on the under surface of the backing plate; and at least one additional laterally directed row of alternately shorter and longer combing teeth downstanding from the backing plate rearwardly of the foremost row, each longer and shorter tooth of each additional row being aligned respectively with a shorter and a longer tooth of the row immediately forward thereof, the shorter teeth of each additional row being positioned between rearward portions of the longer teeth of the row, and each additional tooth in each additional row having a rearmost elongate portion of generally triangular cross section and a foremost portion joining the rearmost portion and tapering therefrom laterally and upwardly to a point on the under surface of the backing plate.

2. The snow combing device of claim 1, further comprising:

a rearmost laterally directed row of snow combing teeth of generally equal length, each aligned with a tooth of the immediately forward row thereto, each tooth having a rearmost elongate portion of generally triangular cross section and a foremost portion joining the rearmost portion and tapering therefrom laterally upwardly to a point on the under surface of the backing plate.

3. The snow combing device of claim 1, further comprising:

a detachable member secured to the trailing edge of the backing plate having a multiplicity of downstanding spiked projections, so as to break up a corduroy pattern of the snow surface produced by the teeth of the rearmost laterally directed row thereof.

4. The snow combing device of claim 2, further comprising:

a detachable member secured to the trailing edge of the backing plate having a multiplicity of downstanding spike projections, so as to break up a corduroy pattern of the snow surface produced by the teeth of the rearmost laterally directed row thereof.

5. The snow combing device of claim 1, further comprising:

a rearmost laterally directed row of snow combing teeth of generally equal length, said teeth being angularly misaligned with the teeth of the row immediately forward thereof, so as to break up a corduroy pattern of the snow surface produced by the teeth of the row immediately forward thereof.

* * * * *